US009037027B2

(12) United States Patent
Oonishi et al.

(10) Patent No.: US 9,037,027 B2
(45) Date of Patent: May 19, 2015

(54) IMAGE FORMING APPARATUS AND METHOD OF FORMING AN IMAGE

(71) Applicant: Konica Minolta, Inc., Tokyo (JP)

(72) Inventors: Taizou Oonishi, Tokyo (JP); Makoto Fujii, Tokyo (JP); Miho Yamano, Tokyo (JP); Kazunori Nishinoue, Tokyo (JP); Hiroshi Matsumoto, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/089,338

(22) Filed: Nov. 25, 2013

(65) Prior Publication Data

US 2014/0147151 A1 May 29, 2014

(30) Foreign Application Priority Data

Nov. 28, 2012 (JP) ..... 2012-260015

(51) Int. Cl.
*G03G 15/20* (2006.01)

(52) U.S. Cl.
CPC ..... *G03G 15/2017* (2013.01); *G03G 15/2042* (2013.01)

(58) Field of Classification Search
USPC ..... 399/69, 67, 329, 328, 45, 68, 33, 122
See application file for complete search history.

(56) References Cited

U.S. PATENT DOCUMENTS

| | | | | |
|---|---|---|---|---|
| 5,307,133 | A * | 4/1994 | Koshimizu et al. | 399/92 |
| 8,095,058 | B2 * | 1/2012 | Chiba | 399/329 |
| 2013/0209145 | A1 * | 8/2013 | Hasegawa | 399/328 |

FOREIGN PATENT DOCUMENTS

| | | | |
|---|---|---|---|
| JP | 2006-091224 | A | 4/2006 |
| JP | 2009-175344 | A | 8/2009 |
| JP | 2010164725 | A | 7/2010 |
| JP | 2011022533 | A | 2/2011 |
| JP | 2011-118287 | A | 6/2011 |
| JP | 2011123324 | A | 6/2011 |
| WO | 2010021219 | A1 | 2/2010 |

OTHER PUBLICATIONS

Japanese Notice of Reasons for Rejection for JP Patent Application Number: 2012-260015; Date of Mailing: Oct. 28, 2014; with English translation.

* cited by examiner

*Primary Examiner* — Roy Y Yi
(74) *Attorney, Agent, or Firm* — Cantor Colburn LLP

(57) ABSTRACT

An image forming apparatus includes: a fixing member; a moving section that moves the fixing member in a sheet width direction; a temperature detection section disposed at a position corresponding to an end portion of the fixing member, the temperature detection section moving together with the fixing member to detect a temperature of the end portion; and a control section that performs a first movement control and a second movement control on the basis of a result of a detection by the temperature detection section, the first movement control being intended to move the fixing member in the sheet width direction in a reciprocating manner with a predetermined cycle, the second movement control being intended to move the fixing member in the sheet width direction so that the temperature of the fixing member falls within a predetermined temperature range.

23 Claims, 7 Drawing Sheets

IMAGE FORMING APPARATUS AND METHOD OF FORMING AN IMAGE

CROSS REFERENCE TO RELATED APPLICATIONS

This application is entitled to and claims the benefit of Japanese Patent Application No. 2012-260015, filed on Nov. 28, 2012, the disclosure of which including the specification, drawings and abstract is incorporated herein by reference in its entirety.

BACKGROUND OF THE INVENTION

1. Field of the Invention

The present invention relates to an image forming apparatus including a fixing section, and a method of forming an image.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

The fixing section includes a fixing side member (for example, fixing belt) disposed on the fixing surface (the surface on which a toner image has been formed) side of sheets, and a back side supporting member (for example, pressure roller) disposed on the back side (the surface opposite the fixing surface) of sheets. The back side supporting member is brought into pressure contact with the fixing side member, thus forming a fixing nip for conveying sheets in a tightly sandwiching manner. In the following description, the fixing side member and the back side supporting member are collectively referred to as a fixing member.

In the above-mentioned image forming apparatus, in the case where images are formed continuously on a large number sheets of the same size, when the relative position between the sheet and the fixing nip in a sheet width direction (a horizontal scanning direction or a direction orthogonal to a sheet conveyance direction) is always the same, edges of lateral end portions of the sheet form edge scars on the fixing member (fixing side member, in particular). Such edge scars lead to decrease in image quality.

As a technique for preventing the edge scar, Japanese Patent Application Laid-Open No. 2006-91224, for example, discloses an image forming apparatus in which a fixing section is translated in a sheet width direction in order to periodically change the relative position between the sheet and a fixing nip in the sheet width direction.

In addition, since variously-sized sheets are typically used in image formation, a sheet passing portion (a portion through which a sheet is passed) and a non-sheet passing portion (a portion through which a sheet is not passed, or a portion near lateral end portions) in a fixing member are differ from sheet to sheet. For example, a non-sheet passing portion for a small-sized sheet may be a sheet passing portion for a large-sized sheet. Meanwhile, the non-sheet passing portion of the fixing member has a temperature higher than that of the sheet passing portion thereof since heat of the non-sheet passing portion does not transferred to sheets. Therefore, when an image formation is performed on a large-sized sheet after an image formation is performed on a small-sized sheet, the temperature distribution of the fixing member in the sheet width direction becomes non-uniform, thus causing uneven fixation, wrinkles or hot offset due to excessive heating.

As a technique for preventing temperature rise at an end portion as the non-sheet passing portion of a fixing member during a fixing operation, Japanese Patent Application Laid-Open No. 2009-175344, for example, discloses an image forming apparatus in which the fixing section is moved to an end side or the other end side in the width direction in accordance with the temperature of the fixing member.

In the following description, the motion of the fixing section in one direction is referred to as "movement" of the fixing section, and in particular, the periodic reciprocating motion of the fixing section is referred to as "translation" of the fixing section.

In addition, Japanese Patent Application Laid-Open No. 2011-118287 discloses that a combination of translation of a fixing section as measures against edge scars and moving of the fixing section in accordance with the temperature of the fixing member is applicable.

However, conventionally, an image forming apparatus which can prevent formation of edge scars on a fixing member and can uniformize the temperature of the fixing member has not been proposed.

Specifically, in Japanese Patent Application Laid-Open No. 2006-91224, the image forming apparatus only translates the fixing section, and the temperature distribution of the fixing member is not taken into account. Therefore, the temperature of the fixing member (in particular, the temperature of an end portion) may become non-uniform when the fixing section is translated.

Since the image forming apparatus in Japanese Patent Application Laid-Open No. 2009-175344 moves the fixing section to an end side or the other end side in accordance with the temperature of the fixing member, it is recognized that the sheet passing region is thereby changed, making it possible to prevent formation of edge scars. However, since image formations are sequentially performed in such states, formation of edge scars cannot be sufficiently prevented.

In addition, the techniques according to Japanese Patent Application Laid-Open Nos. 2006-91224 and 2009-175344 are both intended to be performed during the non-sheet passing period during which sheets do not pass through the fixing nip. Therefore, if the both techniques are used at the same time, only one of the techniques is prioritized, and the effect of the other technique cannot be sufficiently obtained.

The image forming apparatus according to Japanese Patent Application Laid-Open No. 2011-118287 prioritizes moving of the fixing section based on the temperature of the fixing member on the premise that a certain temperature gradient is formed in the fixing member, and therefore the range of translation of the fixing section for preventing formation of edge scars is limited. In addition, in the image forming apparatus according to Japanese Patent Application Laid-Open No. 2011-118287, variation of the temperature distribution of the fixing member (in particular, the temperature of a non-sheet passing portion) with time is not taken into account, and therefore it is difficult to uniformize the temperature of the fixing member.

SUMMARY OF THE INVENTION

An object of the present invention is to provide an image forming apparatus and a method of forming an image which can prevent an edge scar from being formed on a fixing member and can uniformize the temperature thereof to improve image quality.

To achieve the abovementioned object, an image forming apparatus reflecting one aspect of the present invention includes: a fixing member that forms a fixing nip for conveying a sheet in a tightly sandwiching manner, the fixing member heating and pressing a sheet passing through the fixing nip to fix a toner image on the sheet; a moving section that moves the fixing member in a sheet width direction; a temperature detection section disposed at a position corresponding to an end portion of the fixing member, the temperature detection section moving together with the fixing member to detect a temperature of the end portion; and a control section that performs a first movement control and a second movement control on the basis of a result of a detection by the temperature detection section, the first movement control being intended to move the fixing member in the sheet width direction in a reciprocating manner with a predetermined cycle, the second movement control being intended to move the fixing member in the sheet width direction so that the temperature of the fixing member falls within a predetermined temperature range.

To achieve the abovementioned object, in a method of forming an image reflecting one aspect of the present invention, a fixing nip for conveying a sheet in a tightly sandwiching manner is formed by a fixing member and a sheet is conveyed through the fixing nip to apply heat and pressure to the sheet to thereby fix a toner image on the sheet, the method including: causing a temperature detection section to detect a temperature of an end portion of the fixing member; and performing a first movement control and a second movement control on the basis of a result of a detection by the temperature detection section, the first movement control being intended to move the fixing member in the sheet width direction in a reciprocating manner with a predetermined cycle, the second movement control being intended to move the fixing member in the sheet width direction so that the temperature of the fixing member falls within a predetermined temperature range.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

[First Embodiment]

In the following, an embodiment of the present invention is described in detail with reference to the drawings.

Figure 1:
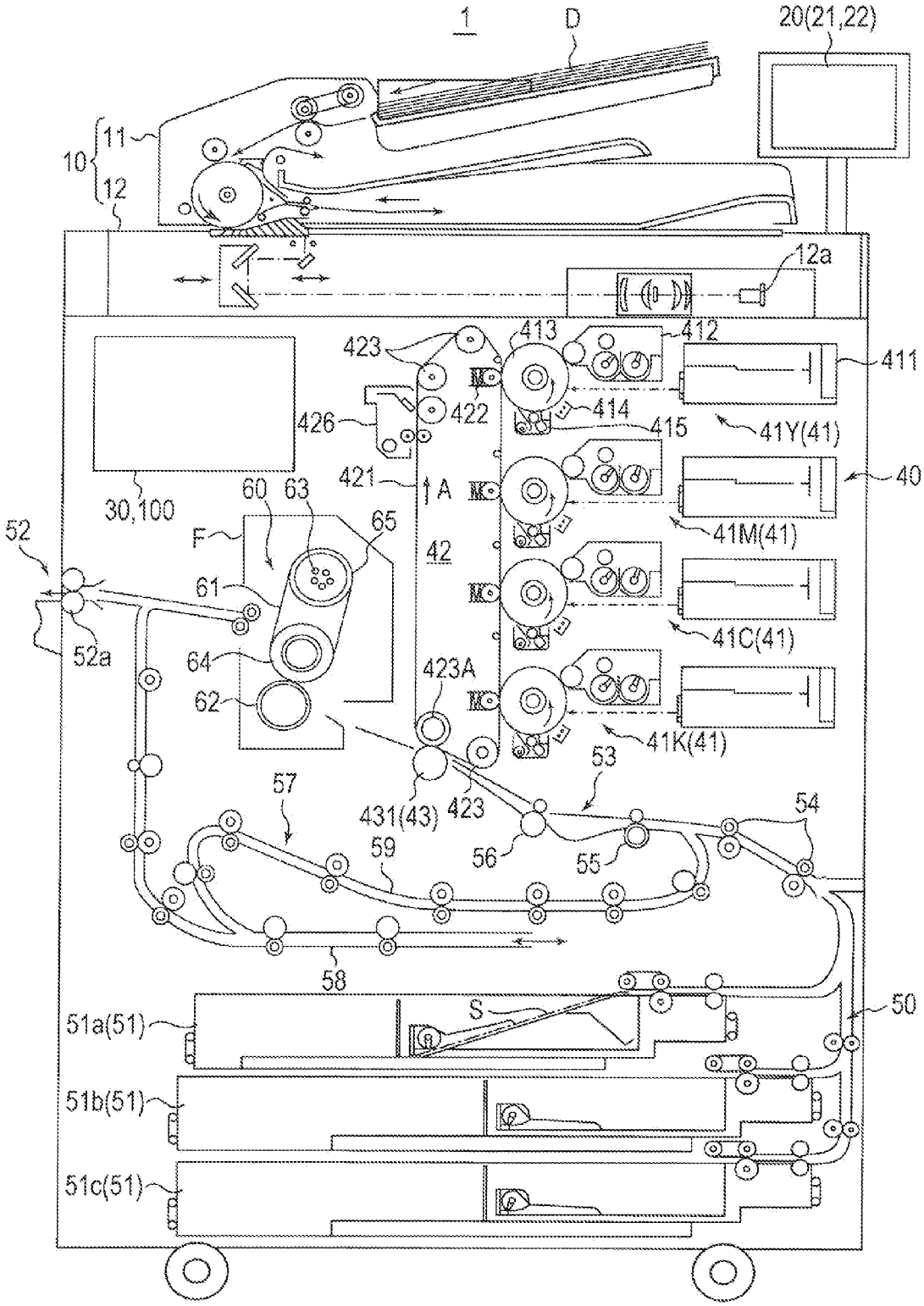
FIG. 1 schematically illustrates an overall configuration of an image forming apparatus according to an embodiment of the present invention.
Figure 2:
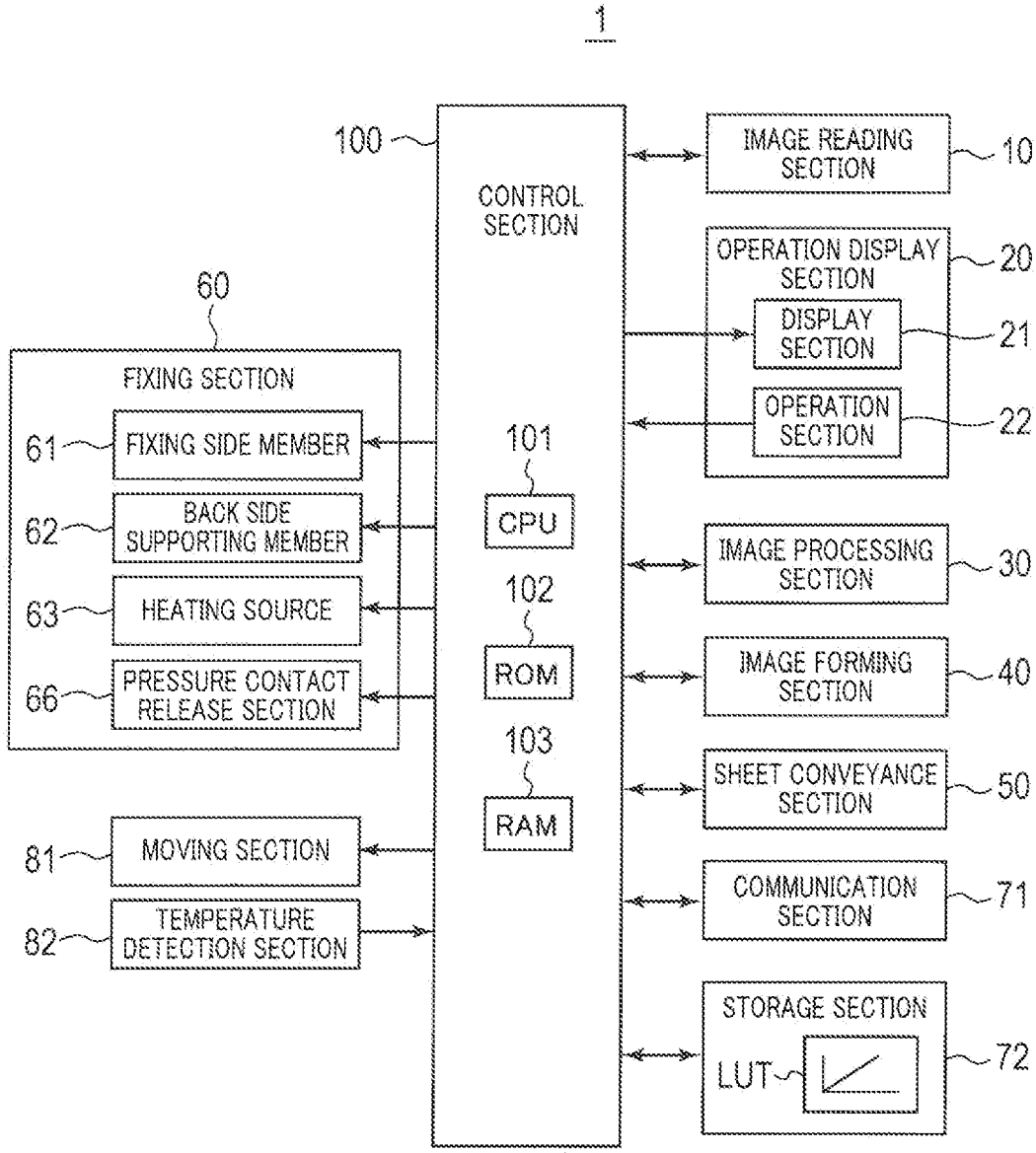
FIG. 2 illustrates a principal part of a control system of the image forming apparatus according to the embodiment.

FIG. 1 illustrates an overall configuration of image forming apparatus 1 illustrate according to the embodiment of the present invention. FIG. 2 illustrates a principal part of a control system of image forming apparatus 1 according to the embodiment.

Image forming apparatus 1 illustrated in FIGS. 1 and 2 is a color image forming apparatus with an intermediate transfer system using electrophotographic process technology. A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

As illustrated in FIGS. 1 and 2, image forming apparatus 1 includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like. Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings, on the input image data, and the like. For example, image processing section 30 performs toner correction on the basis of toner correction data (toner correction table), under the control of control section 100. In addition to the toner correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and secondary transfer unit 43, and the like.

Image forming unit 41 includes image forming units 41Y, 41M, 41C, and 41K for the Y component, the M component, the C component, and the K component. Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drum 413 is, for example, a negatively-charged-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drum 413, whereby photoconductor drum 413 is rotated at a constant circumferential speed.

Charging device 414 evenly negatively charges the surface of photoconductor drum 413.

Exposure device 411 is composed of, for example, a semiconductor laser, and configured to irradiate photoconductor drum 413 with laser light corresponding to the image of each color component. Since the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 due to a difference in potential from its surroundings.

Developing device 412 stores developers of respective color components (for example, two-component developers composed of toner having a small particle size and a magnetic material). Developing device 412 attaches the toners of respective color components to the surface of photoconductor drum 413, and thus visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423 including backup roller 423A, and belt cleaning device 426.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Support roller 423 functions as the driving roller rotates, whereby intermediate transfer belt 421 runs at a constant speed in the arrow A direction. Intermediate transfer belt 421 is brought into pressure contact with photoconductor drums 413 by primary transfer rollers 422, whereby the toner images of the four colors are primary-transferred to intermediate transfer belt 421 so as to be sequentially superimposed on each other.

Secondary transfer unit 43 is composed of secondary transfer roller 431, for example. Secondary transfer unit 43 may have a configuration in which a secondary transfer belt is installed in a stretched state around a plurality of support rollers including the secondary transfer roller in a loop form.

Secondary transfer roller 431A is brought into pressure contact with backup roller 423A with intermediate transfer belt 421 therebetween, whereby a transfer nip (transferring section) is formed. When sheet S passes through the transfer nip, the toner images carried on intermediate transfer belt 421 are secondary-transferred to sheet S. Specifically, a voltage (transfer bias) having a polarity opposite to that of the toner is applied to secondary transfer roller 431, whereby the toner images are electrostatically transferred to sheet S. Sheet S on which the toner images have been transferred is conveyed toward fixing section 60.

Belt cleaning device 426 includes a belt cleaning blade that is brought into sliding contact with the surface of intermediate transfer belt 421, and removes residual toner that remains on the surface of intermediate transfer belt 421 after secondary transfer.

Fixing section 60 heats and pressurizes sheet S conveyed thereto at its fixing nip, to thereby fix the toner images to sheet S. Fixing section 60 is disposed as a unit in fixer F. Fixer F may include an air separation unit that blows air to thereby separate sheet S from fixing side member 61 (for example, a fixing belt) or back side supporting member 62 (for example, a pressure roller).

Fixing section 60 includes fixing side member 61 disposed on the fixing surface (the surface on which a toner image has been formed) side of sheet S, and back side supporting member 62 disposed on the back side (the surface opposite the fixing surface) of sheet S, heating source 63 and the like. Back side supporting member 62 is brought into pressure contact with fixing side member 61, thus forming a fixing nip for conveying sheet S in a tightly sandwiching manner.

Fixing section 60 illustrated in FIG. 1 is of a so-called belt heating system. Specifically, an endless fixing belt installed around fixing roller 64 and heating roller 65 in a stretched state serves as fixing side member 61. In fixing section 60, back side supporting member 62 is composed of a pressure roller. The pressure roller serving as back side supporting member 62 is brought into pressure contact with the fixing belt serving as fixing side member 61 by pressure contact release section 66 (see FIG. 2).

Heating source 63 is composed of, for example, a halogen lamp, resistance heat generation member, or the like, and is incorporated in heating roller 65. Alternatively, heating source 63 may be composed of a member of an electromagnetic induction heating (IH) type.

Heating source 63 heats heating roller 65, and as a result, the fixing belt serving as fixing side member 61 is uniformly heated in the width direction at a predetermined fixing temperature (for example, 170° C.). The fixing temperature is a temperature at which a heat energy required for melting toner on sheet S can be obtained, and the fixing temperature differs depending on factors such as the type of sheet S on which an image is to be formed.

Control section 100 drives and controls fixing side member 61, pressure roller 62, pressure contact release section 66, heating source 63, and the like.

It is to be noted that the configuration of fixing section 60 is not limited to the above-described configuration. For example, fixing side member 61 may be composed of a fixing roller, and back side supporting member 62 may be composed of a pressing belt or a pressing pad.

In the following description, fixing side member 61 and back side supporting member 62 are collectively referred to as fixing member FM.

Sheet conveyance section 50 includes sheet feeding section 51, ejection section 52, first conveyance section 53, second conveyance section 57 and the like.

Three sheet feed tray units 51*a* to 51*c* included in sheet feeding section 51 store sheets S (standard sheets, special sheets) discriminated on the basis of the basis weight, the size, and the like, for each type set in advance.

First conveyance section 53 includes a plurality of conveyance roller sections including intermediate conveyance roller section 54, loop roller section 55, and registration roller section 56, and conveys sheet S fed from sheet feeding section 51 or second conveyance section 57 to a transferring section of image forming section 40. In the course of conveying sheet S by first conveyance section 53, skew and the lateral position (deviation) of sheet S is corrected.

Second conveyance section 57 includes back side conveyance path 59 and switchback path 58 in which a plurality of conveyance roller sections are disposed. Second conveyance section 57 once conveys sheet S to switchback path 58, and then performs a switchback to convey sheet S to back side conveyance path 59, thus inverting sheet S. Thereafter, second conveyance section 57 feeds sheet S to first conveyance section 53 (the upstream of loop roller section 55).

A toner image on intermediate transfer belt 421 is secondary-transferred to one side (image formation surface) of sheet S at one time at the time when sheet S conveyed by first conveyance section 53 passes through the transfer nip, and then a fixing process is performed in fixing section 60. Sheet S on which an image has been formed is ejected out of the image forming apparatus by ejection section 52 including sheet discharging roller 52*a*.

Figure 3:
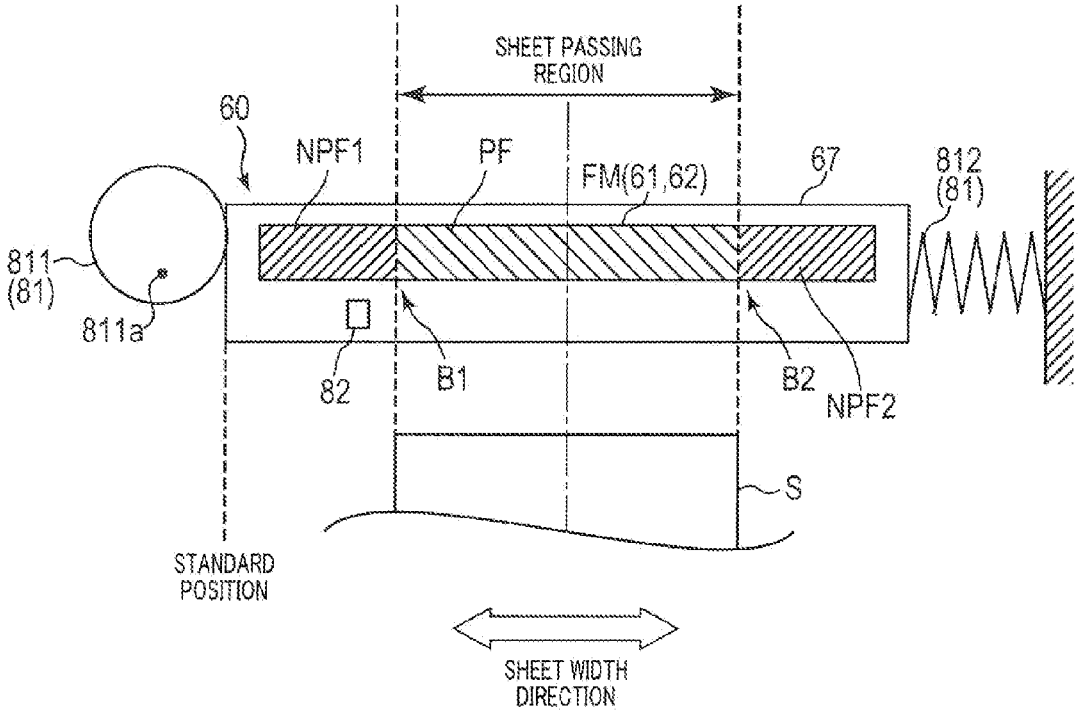
FIG. 3 illustrates a fixing section according to a first embodiment in detail.

FIG. 3 illustrates a translation mechanism of fixing section 60. As illustrated in FIG. 3, fixing member FM composed of fixing side member 61 and back side supporting member 62, and other members making up fixing section 60 are fixed to housing frame 67. Fixing section 60 is mounted to a base member (not illustrated), and is supported movably in the sheet width direction.

In addition, image forming apparatus 1 includes moving section 81 that moves fixing section 60 in the sheet width direction, and temperature detection section 82 that detects the temperature of an end portion of fixing member FM.

Eccentric cam 811 and biasing member 812 are disposed in contact with fixing section 60 on a first end side (in FIG. 3, the left side) and a second end side (in FIG. 3, the right side), respectively, of fixing section 60 in the sheet width direction. Eccentric cam 811 is connected to a drive motor (not illustrated), and is rotated around rotation axis 811*a*. Eccentric cam 811 (drive motor (not illustrated)) is driven and controlled by control section 100. Biasing member 812 biases fixing section 60 toward eccentric cam 811.

Specifically, in this example, moving section 81 is made up of eccentric cam 811, biasing member 812, and the drive motor (not illustrated). Alternatively, moving section 81 may have a configuration using a rack and pinion mechanism.

Figure 4A:
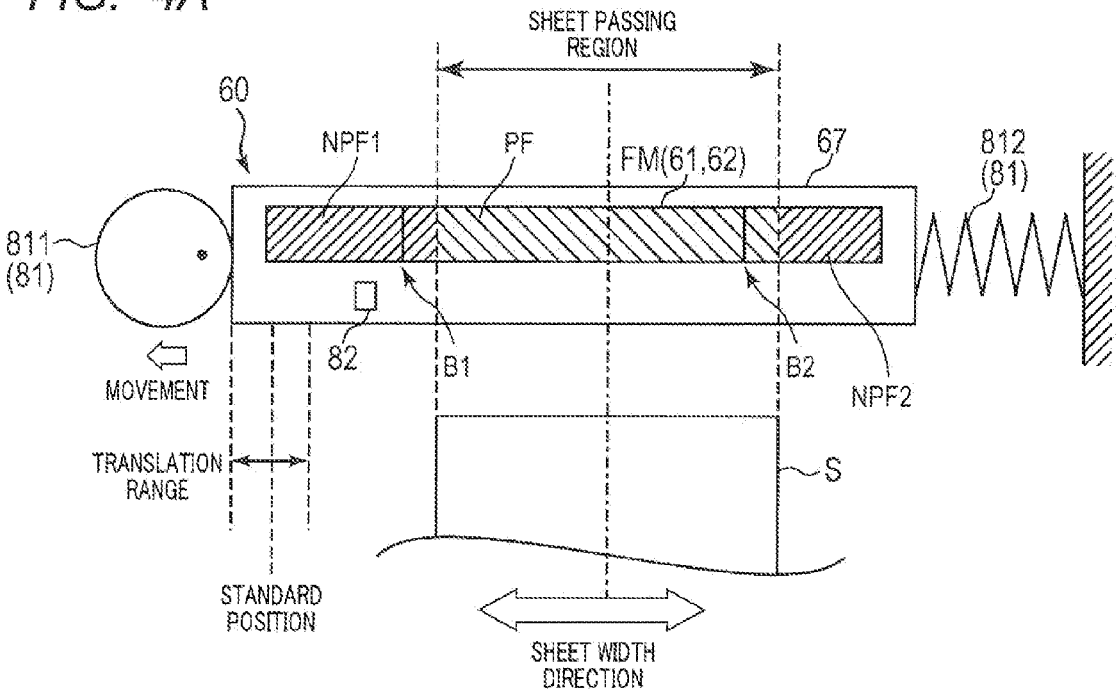
FIGS. 4A and 4B each illustrate a translation state.
Figure 4B:
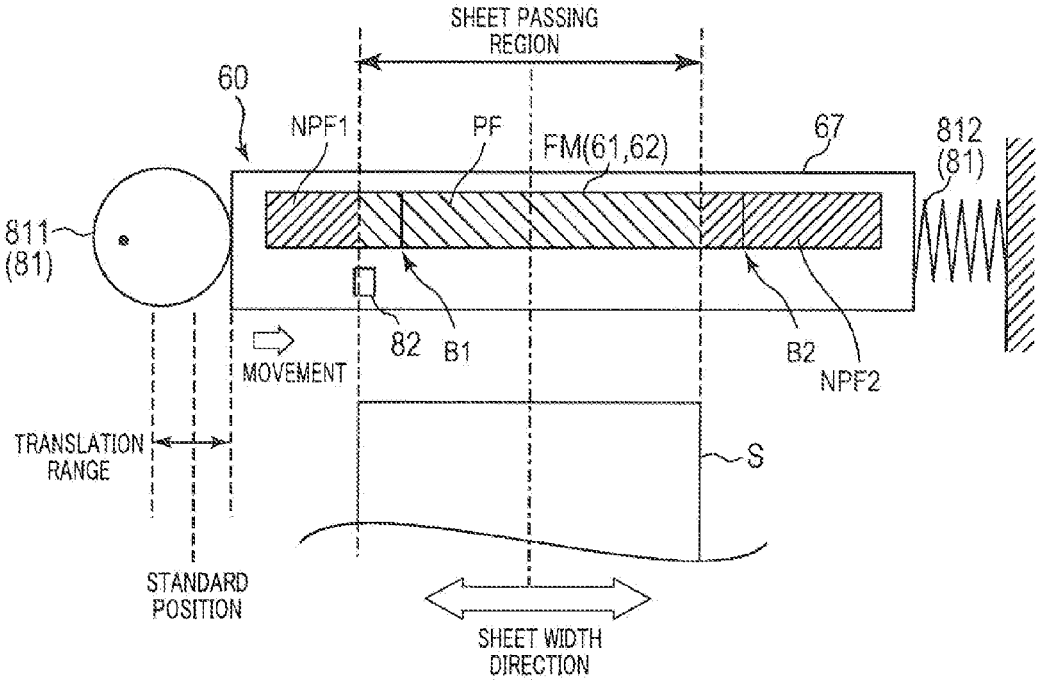

When eccentric cam 811 rotates around rotation axis 811*a*, fixing section 60 moves in the sheet width direction (see FIGS. 4A and 4B). For example, when eccentric cam 811 rotates counterclockwise in a standard state illustrated in FIG. 3, fixing section 60 moves to the left side relative to the standard state (see FIG. 4A) and when eccentric cam 811 rotates clockwise in the standard state illustrated in FIG. 3, fixing section 60 moves to the right side relative to the standard state (see FIG. 4B). In other words, when eccentric cam 811 rotates around rotation axis 811*a*, fixing section 60 translates in the sheet width direction within a predetermined range with respect to the standard state as the center of the translation.

When fixing section 60 is in the standard state illustrated in FIG. 3, sheet S is conveyed such that it passes through the center portion of fixing member FM in the sheet width direction. Specifically, in the standard state, the center portion of fixing member FM in the sheet width direction is sheet passing portion PF corresponding to the sheet passing region of sheet S, and the both end portions thereof are non-sheet passing portions NPF1 and NPF2 corresponding to the non-sheet passing regions of sheet S. A temperature control of sheet passing portion PF of fixing member FM is performed in consideration of transmission of heat energy to sheet S, and a temperature control of non-sheet passing portion PF of fixing member FM is performed in consideration of the fact that the amount of the heat energy transmitted to sheet S is small.

In this case, when fixing section 60 moves in the sheet width direction, sheet passing portion PF, non-sheet passing portions PF1 and PF2 of fixing member FM change. Specifically, portions near boundaries B1 and B2 of sheet passing portion PF and non-sheet passing portions NPF1 and NPF2 in the standard state become sheet passing portion PF, or non-sheet passing portions NPF1 and NPF2 as fixing section 60 moves. Then, the temperature control of heating source 63 may become insufficient, and as a result, the portions near boundaries B1 and B2 between sheet passing portion PF and non-sheet passing portions NPF1 and NPF2 may have a temperature which is inadequate for the fixing process and deteriorates fixing performance.

Meanwhile, in fixing section 60, normally, a certain airflow is created by a fan motor, air duct and the like in order to eject heat (which occasionally contains water vapor) from fixer F or sheet S output by fixer F, to the outside. For example, when an exhaust port is provided on the back face of the main body of image forming apparatus 1 (on the depth side of the sheet surface in FIG. 1, and the right side in FIG. 3), an airflow from the left side to the right side is created in fixing section 60 illustrated in FIG. 3. In this case, the temperature tends to drop at the left end portion of fixing member FM, while the temperature tends to rise at the right end portion of fixing member FM.

Under such circumstances, in the present embodiment, temperature detection section 82 detects the temperature at the end portion of fixing member FM, and a movement control of fixing section 60 is performed so that the temperature of fixing member FM falls within a predetermined temperature range on the basis of results of the detection.

For example, temperature detection section 82 is fixed to housing frame 67 so as to move along with the movement of fixing section 60. That is, temperature detection section 82 detects the temperature of a predetermined portion of fixing member FM regardless of whether the fixing section 60 moves or not.

Temperature detection section 82 may be a contact type member such as a thermistor and a thermocouple, or a non-contact type member such as an NC sensor. In addition, heating source 63 may be driven and controlled on the basis of results of detection by temperature detection section 82.

In this example, temperature detection section 82 is disposed at a position corresponding to a first end portion of fixing member FM (in FIG. 3, left end portion). It can be said that the behavior of temperature variation in a second end portion of fixing member FM (in FIG. 3, right end portion) is typically opposite to that in the first end portion thereof, and therefore, temperature detection section 82 of the first embodiment is disposed at the position corresponding only to the first end portion of fixing member FM.

Here, the end portions of fixing member FM are portions which always serve as the non-sheet passing portion or the sheet passing portion, or temporarily serve as the non-sheet passing portion or the sheet passing portion when fixing section 60 moves. Preferably, temperature detection section 82 is disposed near the boundary (in this example, boundary B 1) between sheet passing portion PF and non-sheet passing portions NPF1 and NPF2 in the standard state. With such a configuration, it is possible to accurately detect temperature variation at a portion of fixing member FM where the transmission mode of heat energy varies as fixing section 60 moves.

Preferably, the position of temperature detection section 82 in the sheet width direction can be adjusted on the basis of information on the width of sheet S used for image formation. This is because, if temperature detection section 82 is disposed in a fixed manner, the relative position (distance) between temperature detection section 82 and the sheet end portion changes depending on sheet sizes (sheet widths), and thus, in some cases, the temperature near boundaries B1 and B2 between sheet passing portion PF and non-sheet passing portions NPF1 and NPF2 in the standard state may not be accurately detected depending on sheet types. That is, with the configuration of the present embodiment, even when the width of sheet S used for image formation is changed, the temperature near boundaries B1 and B2 between sheet passing portion PF and non-sheet passing portions NPF1 and NPF2 in the standard state can be accurately detected.

In the present embodiment, as measures against the edge scar, a first movement control is performed in which fixing section 60 is reciprocatingly moved in the sheet width direction with a predetermined cycle. In addition, a second movement control is performed in which fixing section 60 is moved in the sheet width direction on the basis of the results of the detection by temperature detection section 82 in order to uniformize the temperature of fixing member FM. To be more specific, control section 100 performs a fixation movement control process illustrated in FIG. 5, thereby selectively performing the first movement control and the second movement control.

Figure 5:
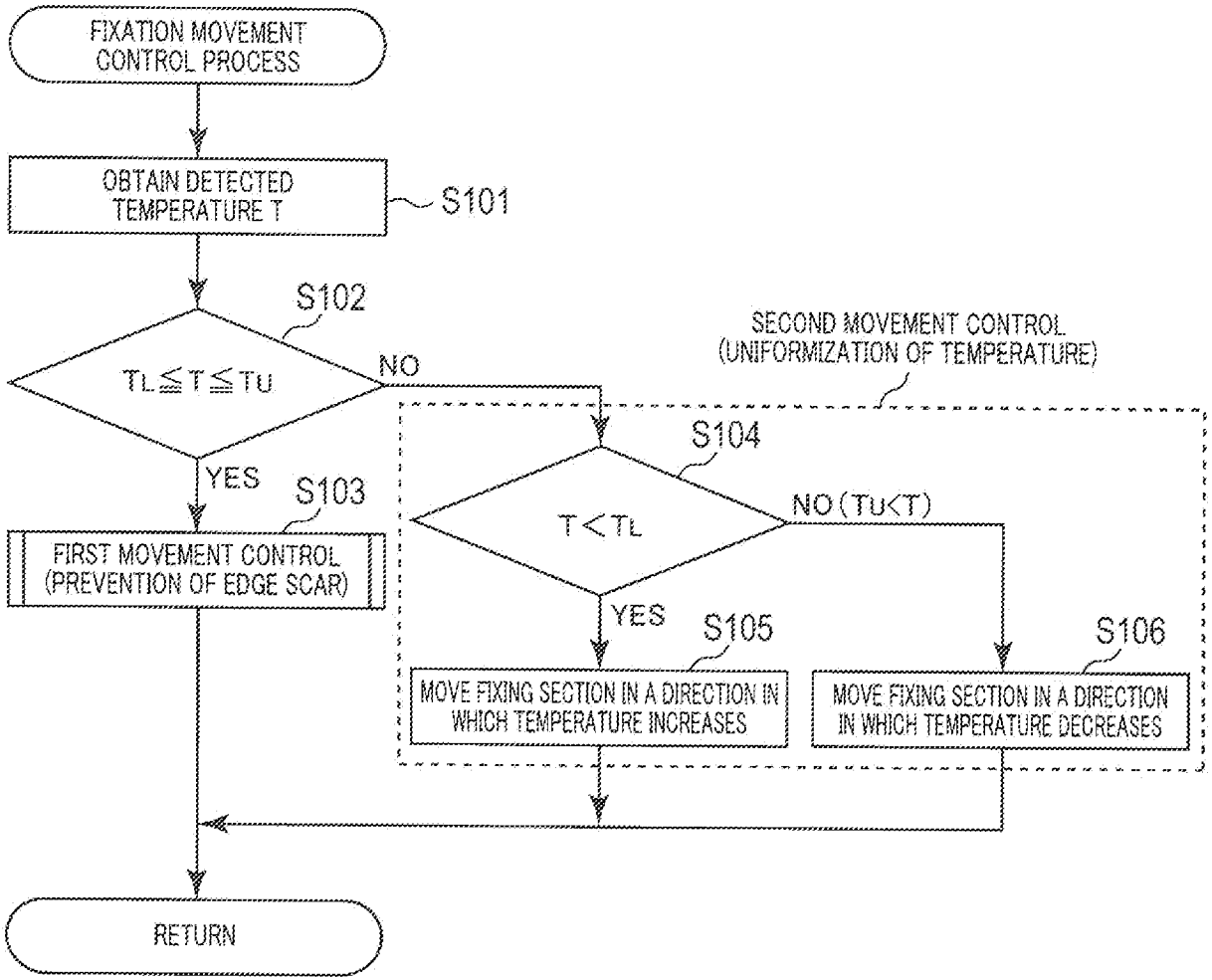
FIG. 5 is a flowchart illustrating an exemplary fixation movement control process according to the first embodiment.

FIG. 5 is a flowchart illustrating an exemplary fixation movement control process according to the first embodiment. The fixation movement control process illustrated in FIG. 5 is achieved when CPU 101 executes a predetermined program stored in ROM 102 as an image formation process is started, for example. In the following description, for convenience, it is assumed that temperature detection section 82 is disposed so as to detect the temperature of the left end portion of fixing member FM (see FIG. 3), and that the fixing temperature of fixing member FM is 170° C.

At step S101 in FIG. 5, control section 100 obtains detected temperature T (the temperature of the left end portion of fixing member FM) detected by temperature detection section 82. When the first movement control or the second movement control is performed, the left end portion of fixing member FM corresponding to temperature detection section 82 is brought nearer to the sheet passing region (or becomes the sheet passing region in some cases) or distanced from the sheet passing region, and accordingly, detected temperature T detected by temperature detection section 82 changes. To be more specific, when the left end portion of fixing member FM is brought nearer to the sheet passing region, the heat energy transmitted to sheet S increases, and accordingly detected temperature T drops. On the other hand, when the left end portion of fixing member FM is distanced from the sheet passing region, the heat energy transmitted to sheet S decreases, and accordingly detected temperature T rises.

At step S102, control section 100 determines whether detected temperature T falls within a predetermined temperature range. The predetermined temperature range is a range of temperature which is set to determine whether the temperature at sheet passing portion PF of fixing member FM can be maintained at about a fixing temperature (for example, a fixing temperature of 170° C.±5° C.) even when fixing section 60 moves. When the fixing temperature is 170° C., the predetermined temperature range is set to 165° C. to 190° C., for example. That is, when detected temperature T falls within the range of 165° C. to 190° C., the temperature of sheet passing portion PF of fixing member FM is maintained at ±5° C. of the fixing temperature even when fixing section 60 moves in either direction, but when detected temperature T is lower than 165° C. or greater than 190° C., the temperature of sheet passing portion PF may fall outside the range of ±5° C. of the fixing temperature when fixing section FM moves in either direction.

When control section 100 determines that detected temperature T falls within the predetermined temperature range (in this example, 165° C. to 190° C.), the process is advanced to step S103 and the first movement control is performed.

When control section 100 determines that detected temperature T falls outside the predetermined temperature range, process is advanced to step S104, and the second movement control is performed. Thus, it is possible to efficiently prevent the edge scar from being formed on the fixing member, and uniformize the temperature thereof, thereby improving image quality.

When detected temperature T falls within the predetermined temperature range ("YES" in step S102), control section 100 performs the first movement control at step S103. Specifically, in that case, it is possible to determine that the temperature of sheet passing portion PF can be maintained at about the fixing temperature even when fixing section 60 moves, and therefore the first movement control for preventing formation of the edge scar is performed.

The first movement control causes fixing section 60 to reciprocatingly move in the sheet width direction with a predetermined cycle.

The operation for moving fixing section 60 in the first movement control is preferably performed during the non-sheet passing period (or intermission) during which sheet S does not pass through the fixing nip. When fixing section 60 is moved during the sheet passing period, sheet S is twisted, and thus a sheet passage error due to paper wrinkle and image noise due to image rubbing may occur. In addition, when the operation for moving fixing section 60 is performed in the non-sheet passing period, the moving speed of fixing section 60 can be set at a speed higher than that in the second movement control (1.0 mm/sec, for example). With such a configuration, the relative position between a sheet and the fixing nip in the sheet width direction can be greatly changed, and thus formation of the edge scar can be efficiently prevented.

When detected temperature T falls outside the predetermined temperature range ("NO" in step S102), control section 100 determines whether detected temperature T is lower than lower limit temperature $T_L$ (in this example, 165° C.), specifically, whether detected temperature T falling outside the predetermined temperature range is lower than lower limit temperature $T_L$, or greater than upper limit temperature $T_U$ at step S104. When control section 100 determines that detected temperature $T_U$ is lower than lower limit temperature $T_L$, the process is advanced to step S105, and when control section 100 determines that detected temperature T is greater than lower limit temperature $T_L$, in other words, when control section 100 determines that detected temperature T is greater than upper limit temperature $T_U$ (in this example, 190° C.), the process is advanced to step S106.

For example, when fixing section 60 is moved to the right side from the standard state illustrated in FIG. 3, sheet S passes through a portion relatively near the left end portion of fixing member FM, in other words, the left end portion of fixing member FM is brought nearer to the sheet passing region. In this case, since the heat energy transmitted from the left end portion of fixing member FM to sheet S increases, a phenomenon in which detected temperature T becomes lower than lower limit temperature $T_L$ may occur. On the other hand, when fixing section 60 is moved to the left side from the standard state illustrated in FIG. 3, sheet S passes through a portion relatively near the right end portion of fixing member FM, in other words, the left end portion of fixing member FM is distanced from the sheet passing region. In this case, since the heat energy transmitted from the left end portion of fixing member FM to sheet S decreases, a phenomenon in which detected temperature T exceeds upper limit temperature $T_U$ may occur.

When detected temperature T is lower than lower limit temperature $T_L$ ("YES" in step S104), control section 100 moves fixing section 60 in a direction in which the temperature of the left end portion of fixing member FM increases, at step S105. The direction in which the temperature of the left end portion of fixing member FM increases is a direction in which the left end portion of fixing member FM is distanced from the sheet passing region, and in this example, a direction toward the left side. The moving direction is inverted when fixing section 60 is moved to the right side, but the moving direction is not changed when fixing section 60 is moved to the left side.

When the left end portion of fixing member FM is distanced from the sheet passing region, the heat energy supplied from heating source 63 surpasses the heat energy absorbed by sheet S, whereby the temperature drop at the left end portion of fixing member FM is suppressed. When the second movement control is repeated, the temperature of the left end portion of fixing member FM is immediately reset to a temperature falling within the predetermined temperature range. When the temperature of the left end portion of fixing member FM have reset to a temperature falling within the predetermined temperature range, the first movement control is performed in the next fixation movement control process.

In the state where fixing section 60 has been moved to the right side and thus detected temperature T is lower than lower limit temperature $T_L$, if fixing section 60 is further moved to the right side, the heat energy transmitted to sheet S may become insufficient, causing a fixing defect. In the present embodiment, such a defect can be prevented since the second movement control of step S105 is performed.

Here, the operation for moving fixing section 60 in the second movement control of step S105 is preferably performed also during the sheet passing period during which sheet S passes through the fixing nip. With such a configuration, the temperature of the left end portion of fixing member FM can be increased to the predetermined temperature range in a short time. At this time, the moving speed in the second movement control is set to such a low speed that sheet S is not twisted (for example, 0.2 mm/sec). In addition, in the second movement control, the moving speed may be set to a high speed (for example, 1.0 mm/sec) during the non-sheet passing period during which consideration for the twist of sheet S is unnecessary. With such a configuration, formation of the edge scar can be effectively prevented, and at the same time, the temperature of the left end portion of fixing member FM can be increased more efficiently.

Further, control section 100 may set the moving speed of fixing section 60 on the basis of the difference between the result of detection by temperature detection section 82 and the predetermined temperature range (the temperature difference between detected temperature T and lower limit temperature $T_L$). For example, as shown in Table 1, the moving speed is so set that the speed increases as the difference between detected temperature T detected by temperature detection section 82 and lower limit temperature $T_L$ (in this example, 165° C.) increases. In addition, when detected temperature T is increased by the second movement control, the moving speed is set to a speed corresponding to detected temperature T thus increased (a speed lower than the immediately preceding moving speed). Thus, the temperature of the left end portion of fixing member FM can be increased more efficiently while preventing the twist of sheet S. Such a configuration is effective for the case where the temperature of the left end portion of fixing member FM is not improved even after the second movement control is performed.

TABLE 1

| | Detected Temperature [° C.] | | | | |
|---|---|---|---|---|---|
| | Below 161 | 161 to 162 | 162 to 163 | 163 to 164 | 164 to 165 |
| Moving Speed [mm/sec] | 1.0 | 0.8 | 0.6 | 0.4 | 0.2 |

When detected temperature T is greater than upper limit temperature $T_U$ ("NO" in step S104), control section 100 moves fixing section 60 in a direction in which the temperature of the left end portion of fixing member FM decreases, at step S106. The direction in which the temperature of the left end portion of fixing member FM decreases is a direction in which the left end portion of fixing member FM is brought nearer to the sheet passing region, and in this example, a direction toward the right side. The moving direction is inverted when fixing section 60 is moved to the left side, but the moving direction is not changed when fixing section 60 is moved to the right side.

When the left end portion of fixing member FM is brought nearer to the sheet passing region, the heat energy absorbed by sheet S surpasses the heat energy supplied from heating source 63, whereby temperature rise at the left end portion of fixing member FM is suppressed. When the second movement control is repeated, the temperature of the left end portion of fixing member FM is immediately reset to a temperature falling within the predetermined temperature range. When the temperature of the left end portion of fixing member FM have reset to a temperature falling within the predetermined temperature range, the first movement control is performed in the next fixation movement control process.

In the state where fixing section 60 has been moved to the left side and thus detected temperature T is greater than upper limit temperature $T_U$, if fixing section 60 is further moved to the left side, the temperature of the left end portion of fixing member FM may be excessively increased, causing hot offset when the moving direction is inverted in the subsequent operations. In addition, if the temperature of fixing member FM is maintained at a high temperature, the durability of fixing member FM (in particular, rubber materials and adhesive interfaces) is degraded at an accelerated rate. In the present embodiment, such a defect can be prevented since the second movement control of step S106 is performed.

Similarly to the second movement control of step S105, the operation for moving fixing section 60 in the second movement control of step S106 is preferably performed also during the sheet passing period during which sheet S passes through the fixing nip. With such a configuration, the temperature of the left end portion of fixing member FM can be decreased to the predetermined temperature range in a short time. At this time, the moving speed in the second movement control is set to such a low speed that sheet S is not twisted (for example, 0.2 mm/sec). In addition, in the second movement control, the moving speed may be set to a high speed (for example, 1.0 mm/sec) during the non-sheet passing period during which consideration for the twist of sheet S is unnecessary. With such a configuration, formation of the edge scar on fixing member FM can be effectively prevented, and at the same time, the temperature of the left end portion of fixing member FM can be decreased more efficiently.

Further, control section 100 may set the moving speed of fixing section 60 on the basis of the difference between the result of detection by temperature detection section 82 and the predetermined temperature range (the temperature difference between detected temperature T and lower limit temperature $T_U$). For example, as shown in Table 2, the moving speed is so set that the speed increases as the difference between detected temperature T detected by temperature detection section 82 and lower limit temperature $T_L$ (in this example, 190° C.) increases. In addition, when detected temperature T is decreased by the second movement control, the moving speed is set to a speed corresponding to detected temperature T thus decreased (a speed lower than the immediately preceding moving speed). Thus, the temperature of the left end portion of fixing member FM can be decreased more efficiently while preventing the twist of sheet S. Such a configuration is effective for the case where the temperature of the left end portion of fixing member FM is not improved even after the second movement control is performed.

TABLE 2

| | Detected Temperature [° C.] | | | | |
|---|---|---|---|---|---|
| | 190 to 195 | 195 to 200 | 200 to 205 | 205 to 210 | Greater than 210 |
| Moving Speed [mm/sec] | 0.2 | 0.4 | 0.6 | 0.8 | 1.0 |

It is to be noted that, after fixing section 60 is moved to the rightmost position in the translation range by the second movement control of step S105 as illustrated in FIG. 4B, or after fixing section 60 is moved to the leftmost position in the translation range by the second movement control of step S106 as illustrated in FIG. 4A, the state of fixing section 60 thus established is maintained for a predetermined time. When detected temperature T is not improved even after the predetermined time has passed, it is possible to stop the image formation process by determining that an error has occurred.

In addition, in the second movement control of steps S105 and S106, control section 100 may change the moving speed on the basis of an amount of temperature variation in a predetermined time period computed from results of detection by temperature detection section 82. With such a configuration, the temperature of the left end portion of fixing member FM can be efficiently reset to a temperature falling within the predetermined temperature range.

To be more specific, temperature variation amount ΔT in a predetermined time period at a time immediately before detected temperature T falls below lower limit temperature $T_L$, or at a time immediately before detected temperature T exceeds upper limit temperature $T_U$ is great (for example, $\Delta T > 0.8°$ C./sec), the moving speed in the second movement control is set to a high speed (for example 0.4 mm/sec), and temperature variation amount ΔT in a predetermined time period at a time immediately before detected temperature T falls below lower limit temperature $T_L$, or at a time immediately before detected temperature T exceeds upper limit temperature $T_U$ is small (for example, $\Delta T < 0.8°$ C./sec), the moving speed of the second movement control is set to a low speed (for example, 0.2 mm/sec).

As described above, image forming apparatus 1 according to the first embodiment includes: fixing member FM that forms a fixing nip for conveying sheet S in a tightly sandwiching manner, fixing member FM heating and pressing sheet S passing through the fixing nip to fix a toner image on sheet S; moving section 81 that moves fixing member FM in a sheet width direction; temperature detection section 82 disposed at a position corresponding to an end portion of fixing member FM, temperature detection section 82 moving together with fixing member FM to detect a temperature of the end portion; and control section 100 that performs a first movement control and a second movement control on the basis of a result of a detection by temperature detection section 82, the first movement control being intended to move fixing member FM in the sheet width direction in a reciprocating (translating) manner with a predetermined cycle, the second movement control being intended to move fixing member FM in the sheet width direction so that the temperature of fixing member FM falls within a predetermined temperature range.

With image forming apparatus 1 according to the first embodiment, since the first and second movement controls are performed in fixing section 60 in such a manner that the first and second movement controls are appropriately switched, formation of the edge scar on fixing member FM can be prevented by the first movement control and the temperature at fixing member FM can be uniformized by the second movement control, thus improving image quality.

[Second Embodiment]

In the first embodiment, it can be assumed that the behavior of temperature variation in the second end portion of fixing member FM (in FIG. 3, right end portion) is typically opposite to that in the first end portion thereof, and therefore, temperature detection section 82 is disposed at a position corresponding to the first end portion of fixing member FM. However, in the first embodiment, even when the temperature of the right end portion of fixing member FM falls outside the predetermined temperature range, the second movement control is not performed unless the temperature of the left end portion falls outside the predetermined temperature range.

Figure 6:
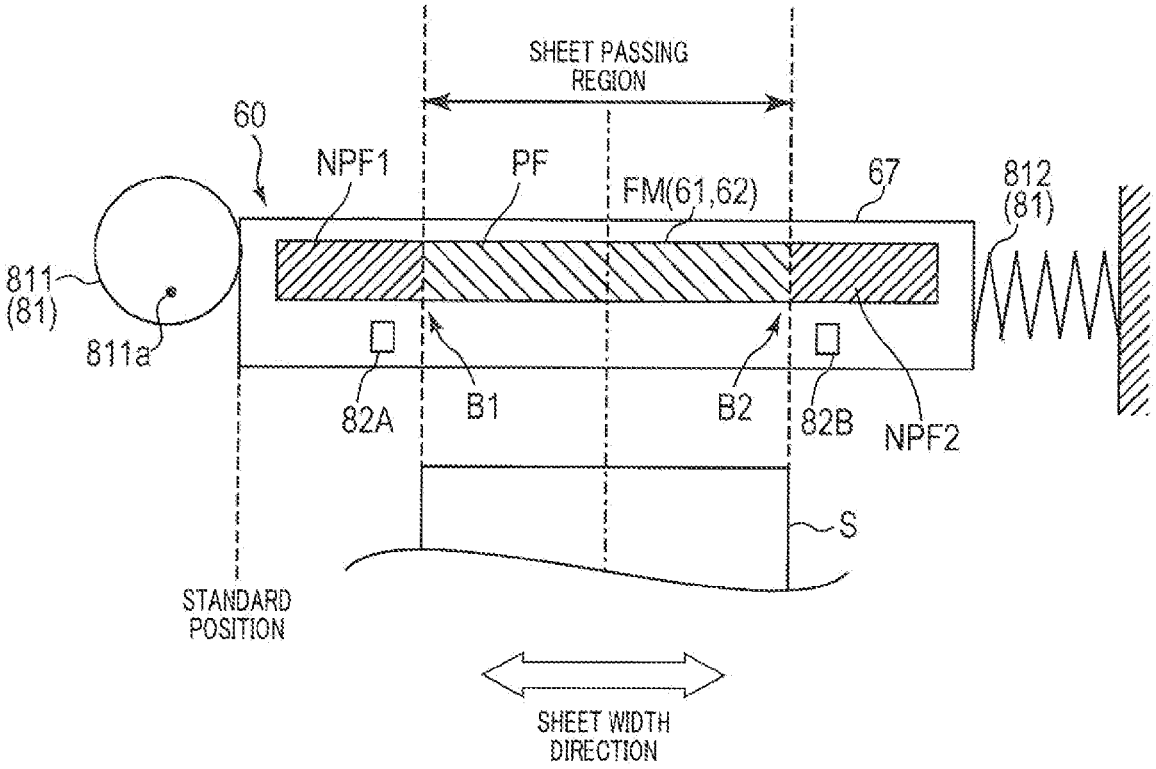
FIG. 6 illustrates a fixing section according to a second embodiment in detail.

In contrast, in the second embodiment, as illustrated in FIG. 6, first temperature detection section 82A and second temperature detection section 82B are respectively disposed at positions corresponding to the left and right end portions of fixing member FM. With such a configuration, it is possible to deal with the case where the temperature of only one of the end portions of fixing member FM falls outside the predetermined temperature range.

Preferably, temperature detection sections 82A and 82B are respectively disposed at positions near boundaries B1 and B2 between sheet passing portion PF and non-sheet passing portions NPF1 and NPF2 in the standard state. With such a configuration, it is possible to accurately detect temperature variation at a portion of fixing member FM where the transmission mode of heat energy varies along with the movement of fixing section 60. It is to be noted that, since the other configurations of the second embodiment are the same as those of the first embodiment, description thereof are omitted.

Figure 7:
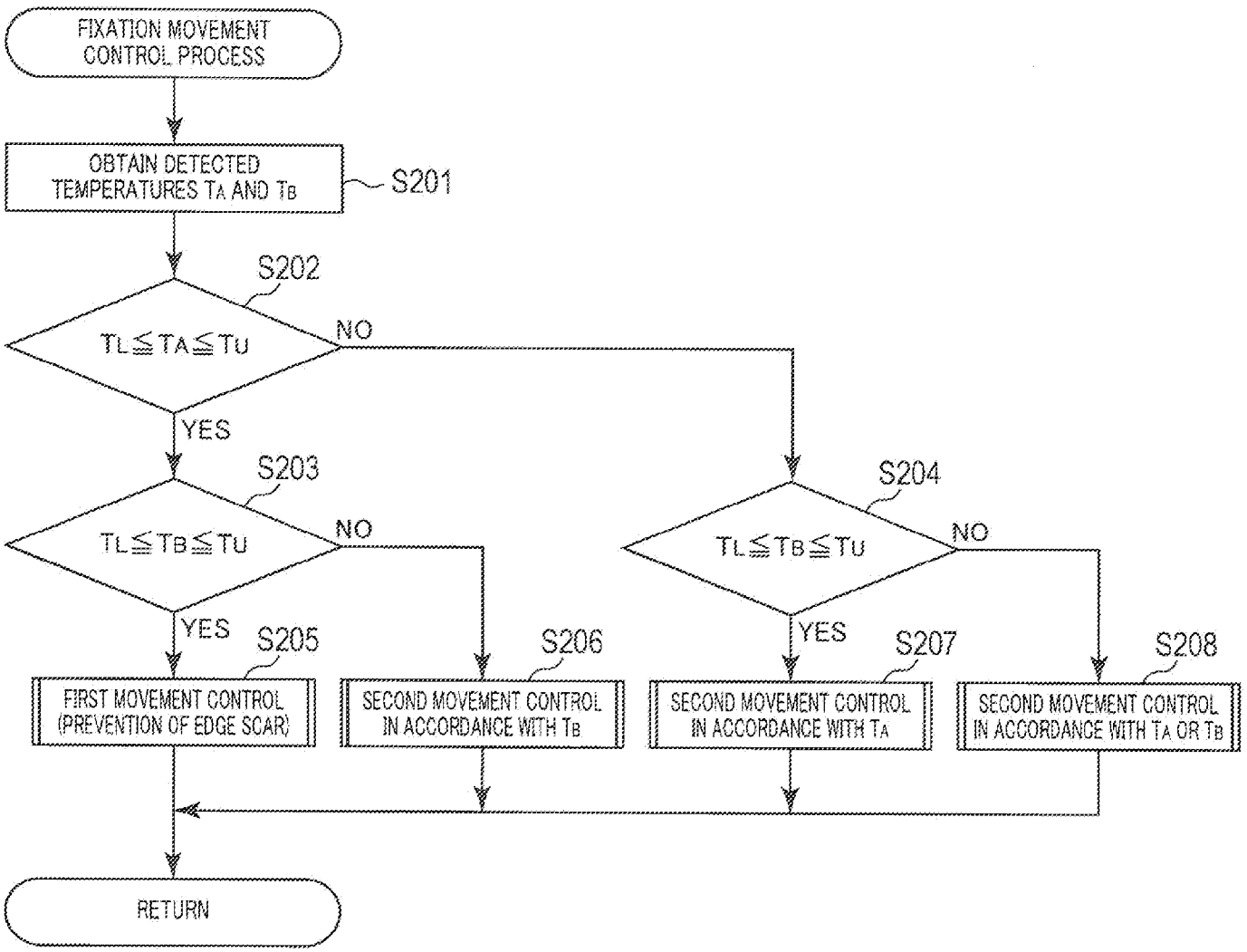
FIG. 7 is a flowchart illustrating an exemplary fixation movement control process according to the second embodiment.

FIG. 7 is a flowchart illustrating an exemplary fixation movement control process according to the second embodiment. The fixation movement control process illustrated in FIG. 7 is achieved when CPU 101 executes a predetermined program stored in ROM 102 when an image formation process is started, for example. It is to be noted that, in the fixation movement control process of FIG. 7, the descriptions of the same matters as in the first embodiment are omitted.

At step S201 of FIG. 7, control section 100 obtains first detected temperature $T_A$ detected by first temperature detection section 82A, and second detected temperature $T_B$ detected by second temperature detection section 82B.

At step S202, control section 100 determines whether first detected temperature $T_A$ falls within a predetermined temperature range (in this example, 165° C. to 190° C.). Then, when control section 100 determines that first detected temperature $T_A$ falls within the predetermined temperature range, the process is advanced to step S203, and when control section 100 determines that first detected temperature $T_A$ falls outside the predetermined temperature range, the process is advanced to step S204.

At step S203, control section 100 determines whether second detected temperature $T_B$ falls within a predetermined temperature range (in this example, 165° C. to 190° C.). Then, when control section 100 determines that second detected temperature $T_B$ falls within the predetermined temperature range, the process is advanced to step S205, and when control section 100 determines that second detected temperature $T_B$ falls outside the predetermined temperature range, the process is advanced to step S206.

Similarly to step S203, at step S204, control section 100 determines whether second detected temperature $T_B$ falls within a predetermined temperature range (in this example, 165° C. to 190° C.). Then, when control section 100 determines that second detected temperature $T_B$ falls within the predetermined temperature range, the process is advanced to step S207, and when control section 100 determines that second detected temperature $T_B$ falls outside the predetermined temperature range, the process is advanced to step S208.

When first detected temperature $T_A$ and second detected temperature $T_B$ both fall within the predetermined temperature range ("YES" in step S202 and then "YES" in step S203), control section 100 performs the first movement control at step S205. Specifically, it can be assumed that the temperature of sheet passing portion PF is maintained at about a fixing temperature even when fixing section 60 moves, and therefore the first movement control for preventing formation of the edge scar is performed.

When first detected temperature $T_A$ falls within the predetermined temperature range, and second detected temperature $T_B$ falls outside the predetermined temperature range ("YES" in step S202 and then "NO" in step S203), control section 100 performs the second movement control in accordance with second detected temperature $T_B$, at step S206. This second movement control is the same as that in steps S104 to S106 of FIG. 5.

Specifically, when second detected temperature $T_B$ is lower than lower limit temperature $T_L$, control section 100 moves fixing section 60 in a direction in which the temperature of the right end portion of fixing member FM increases. The moving speed at this time is controlled as in the first embodiment. When the second movement control is repeated, the temperature of the right end portion of fixing member FM is reset to a temperature falling within the predetermined temperature range.

In addition, when second detected temperature $T_B$ is greater than upper limit temperature $T_U$, control section 100 moves fixing section 60 in a direction in which the temperature of the right end portion of fixing member FM drops. When the second movement control is repeated, the temperature of the right end portion of fixing member FM is reset to a temperature falling within the predetermined temperature range.

It is to be noted that, while the temperature of the right end portion of fixing member FM is reset to a temperature falling within the predetermined temperature range by the second movement control of step S206, the behavior of temperature variation in the left end portion of fixing member FM is opposite to that in the right end portion. Therefore, first detected temperature $T_A$ may fall outside the predetermined temperature range before second detected temperature $T_B$ is reset to a temperature falling within the predetermined temperature range. In that case the second movement control of step S208 is performed.

When first detected temperature $T_A$ falls outside the predetermined temperature range, and second detected temperature $T_B$ falls within the predetermined temperature range ("NO" in step S202 and then "YES" in step S204), control section 100 performs the second movement control in accordance with second detected temperature $T_A$, at step S207. This second movement control (which includes the control of the moving speed) is the same as that in steps S104 to S106 of FIG. 5.

Specifically, when first detected temperature $T_A$ is lower than lower limit temperature $T_L$, control section 100 moves fixing section 60 in a direction in which the temperature of the left end portion of fixing member FM increases. The moving speed at this time is controlled as in the first embodiment. When the second movement control is repeated, the temperature of the left end portion of fixing member FM is immediately reset to a temperature falling within the predetermined temperature range.

In addition, when first detected temperature $T_A$ is greater than upper limit temperature $T_U$, control section 100 moves fixing section 60 in a direction in which the temperature of the left end portion of fixing member FM drops. When the second movement control is repeated, the temperature of the left end portion of fixing member FM is reset to a temperature falling within the predetermined temperature range.

It is to be noted that, while the temperature of the left end portion of fixing member FM is reset to a temperature falling within the predetermined temperature range by the second movement control of step S207, the behavior of temperature variation in the right end portion of fixing member FM is opposite to that in the left end portion. Therefore, second detected temperature $T_B$ may fall outside the predetermined temperature range before first detected temperature $T_A$ is reset to a temperature falling within the predetermined temperature range. In that case the second movement control of step S208 is performed.

When first detected temperature $T_A$ and second detected temperature $T_B$ both fall outside the predetermined temperature range ("NO" in step S202 and then "NO" in step S204), control section 100 performs the second movement control in accordance with first detected temperature $T_A$ or second detected temperature $T_B$, at step S208. When the second movement control is performed in accordance with first detected temperature $T_A$, the control is performed in the same manner as the process of step S207. When the second movement control is performed in accordance with second detected temperature $T_B$, the control is performed in the same manner as the process of step S206.

Here, whether the second movement control is performed in accordance with first detected temperature $T_A$ or second detected temperature $T_B$ is set in advance.

For example, a setting may be adopted in which the second movement control is performed in accordance with one of first detected temperature $T_A$ and second detected temperature $T_B$ which is greater than upper limit temperature $T_U$ and falls outside the predetermined range. Such a setting is effective for the case where prevention of degradation in the durability of fixing member FM is prioritized.

Alternatively, for example, a setting may be adopted in which the second movement control is performed in accordance with one of first detected temperature $T_A$ and second detected temperature $T_B$ which is greater than lower limit temperature $T_L$ and falls outside the predetermined range. Such a setting is effective for the case where ensuring of the fixing performance of fixing section 60 is prioritized.

Alternatively, for example, a setting may be adopted in which the second movement control is performed in accordance with first detected temperature $T_A$ or second detected temperature $T_B$ which has a greater difference from the predetermined temperature range (difference between detected temperature T and lower limit temperature $T_L$). Such a setting is effective in uniformizing the temperature of fixing member FM.

When the temperature of the left end portion or right end portion of fixing member FM has been reset to a temperature falling within the predetermined temperature range by the second movement control of step S208, the second movement control of step S206 or step S207 is then performed.

In addition, it is unlikely that first detected temperature $T_A$ and second detected temperature $T_B$ both exceed upper limit temperature $T_U$, or fall below lower limit temperature $T_L$ since the behaviors of temperature variation at the left end portion and the right end portion of fixing member FM are opposite to each other. If that happens, it suffices that the second movement control is performed in accordance with one of detected temperatures which has a greater difference from the predetermined temperature range.

As described above, image forming apparatus 1 according to the second embodiment includes: fixing member FM that forms a fixing nip for conveying sheet S in a tightly sandwiching manner, fixing member FM heating and pressing sheet S passing through the fixing nip to fix a toner image on sheet S; moving section 81 that moves fixing member FM in a sheet width direction; temperature detection sections 82A and 82B disposed at a position corresponding to an end portion of fixing member FM, temperature detection sections 82A and 82B moving together with fixing member FM to detect a temperature of the end portion; and control section 100 that performs a first movement control and a second movement control on the basis of a result of a detection by temperature detection sections 82A and 82B, the first movement control being intended to move fixing member FM in the sheet width direction in a reciprocating (translating) manner with a predetermined cycle, the second movement control being intended to move fixing member FM in the sheet width direction so that the temperature of fixing member FM falls within a predetermined temperature range.

With the image forming apparatus 1 according to the second embodiment, since the first and second movement controls are performed in fixing section 60 in such a manner that the first and second movement controls are appropriately switched, formation of the edge scar on fixing member FM can be prevented by the first movement control and the temperature at fixing member FM can be uniformized by the second movement control, thus improving image quality.

In addition, in image forming apparatus 1 according to second embodiment, the temperature detection section includes first temperature detection section 82A disposed at a position corresponding to the left end portion of fixing member FM and second temperature detection section 82B disposed at a position corresponding to the right end portion of fixing member FM, and the second movement control is performed on the basis of first detected temperature $T_A$ (results of detection by first temperature detection section 82A) or second detected temperature $T_B$ (results of detection by second temperature detection section 82B).

With such a configuration, it is possible to deal with the case where the temperature of only one of the end portions of fixing member FM falls outside the predetermined temperature range. In other words, the second movement control is started early, which is effective in uniformizing the temperature of fixing member FM.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, temperature detection section 82 (82A and 82B) of the embodiments may be disposed in a fixed manner outside the sheet passing region of a sheet of the largest-possible size for image formation. Since the acceptable temperature range of the non-sheet passing portion is wide in comparison with that of the sheet passing range, a minimum temperature control (temperature controls for preventing hot offset in the next printing, dealing with gloss noises, etc., and suppressing waiting time) is achieved while sufficiently obtaining the effect of the first movement control as measures against the sheet edge scar.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a fixing member that forms a fixing nip for conveying a sheet in a tightly sandwiching manner, the fixing member heating and pressing a sheet passing through the fixing nip to fix a toner image on the sheet;

a moving section that moves the fixing member in a sheet width direction;

a temperature detection section disposed at a position corresponding to an end portion of the fixing member, the temperature detection section moving together with the fixing member to detect a temperature of the end portion; and a control section that performs a first movement control and a second movement control on the basis of a result of a detection by the temperature detection section, the first movement control being intended to move the fixing member in the sheet width direction in a reciprocating manner with a predetermined cycle, the second movement control being intended to move the fixing member in the sheet width direction so that the temperature of the fixing member falls within a predetermined temperature range.

2. The image forming apparatus according to claim 1, wherein the control section performs the first movement control when the result of the detection by the temperature detection section falls within the predetermined temperature range, and the second movement control when the result of the detection by the temperature detection section falls outside the predetermined temperature range.

3. The image forming apparatus according to claim 1, wherein the control section moves the fixing member in a direction in which a temperature of the end portion corresponding to the temperature detection section drops when the result of the detection by the temperature detection section is greater than an upper limit of the predetermined temperature range, and the fixing member in a direction in which the temperature of the end portion corresponding to the temperature detection section increases when the result of the detection by the temperature detection section is lower than a lower limit of the predetermined temperature range.

4. The image forming apparatus according to claim 1, wherein the control section performs the second movement control at a time when a sheet passes the fixing nip.

5. The image forming apparatus according to claim 1, wherein the control section controls a moving direction and a moving speed of the fixing member.

6. The image forming apparatus according to claim 5, wherein the control section sets the moving speed of the fixing member on the basis of a difference between the result of the detection by the temperature detection section and the predetermined temperature range.

7. The image forming apparatus according to claim 5, wherein the control section changes the moving speed on the basis of an amount of temperature variation in a predetermined time period, the amount of temperature variation being computed on the basis of the result of the detection by the temperature detection section.

8. The image forming apparatus according to claim 1, wherein the temperature detection section is disposed at a position near a boundary between a sheet passing portion through which a sheet passes in a standard state, and a non-sheet passing portion through which no sheet passes in the standard state.

9. The image forming apparatus according to claim 1, wherein the temperature detection section includes a first temperature detection section disposed at a position corresponding to a first end portion of the fixing member, and a second temperature detection section disposed at a position corresponding to a second end portion of the fixing member, and the control section performs the second movement control on the basis of a result of a detection by the first temperature detection section or a result of a detection by the second temperature detection section.

10. The image forming apparatus according to claim 9, wherein the control section performs the second movement control on the basis of a detection result greater than an upper limit of the predetermined temperature range, the detection result being the result of the detection by the first temperature detection section or the result of the detection by the second temperature detection section.

11. The image forming apparatus according to claim 9, wherein the control section performs the second movement control on the basis of a detection result lower than a lower limit of the predetermined temperature range, the detection result being the result of the detection by the first temperature detection section or the result of the detection by the second temperature detection section.

12. The image forming apparatus according to claim 9, wherein the control section performs the second movement control on the basis of a detection result having a greater difference from the predetermined temperature range, the detection result being the result of the detection by the first temperature detection section or the result of the detection by the second temperature detection section.

13. A method of forming an image, wherein a fixing nip for conveying a sheet in a tightly sandwiching manner is formed by a fixing member and a sheet is conveyed through the fixing nip to apply heat and pressure to the sheet to thereby fix a toner image on the sheet, the method comprising:

causing a temperature detection section to detect a temperature of an end portion of the fixing member; and performing a first movement control and a second movement control on the basis of a result of a detection by the temperature detection section, the first movement control being intended to move the fixing member in the sheet width direction in a reciprocating manner with a predetermined cycle, the second movement control being intended to move the fixing member in the sheet width direction so that the temperature of the fixing member falls within a predetermined temperature range.

14. The method according to claim 13, wherein the first movement control is performed when the result of the detection by the temperature detection section falls within the predetermined temperature range, and the second movement control is performed when the result of the detection by the temperature detection section falls outside the predetermined temperature range.

15. The method according to claim 13, wherein the fixing member is moved in a direction in which a temperature of the end portion corresponding to the temperature detection section drops when the result of the detection by the temperature detection section is greater than an upper limit of the predetermined temperature range, and the fixing member is moved in a direction in which the temperature of the end portion corresponding to the temperature detection section increases when the result of the detection by the temperature detection section is lower than a lower limit of the predetermined temperature range.

16. The method according to claim 13, wherein the second movement control is performed at a time when a sheet passes the fixing nip.

17. The method according to claim 13, wherein a moving direction and a moving speed of the fixing member is controlled.

18. The method according to claim 17, wherein the moving speed of the fixing member is set on the basis of a difference between the result of the detection by the temperature detection section and the predetermined temperature range.

19. The method according to claim 17, wherein the moving speed is changed on the basis of an amount of temperature variation in a predetermined time period, the amount of temperature variation being computed on the basis of the result of the detection by the temperature detection section.

20. The method according to claim 13, wherein the temperature detection section includes a first temperature detection section disposed at a position corresponding to a first end portion of the fixing member, and a second temperature detection section disposed at a position corresponding to a second end portion of the fixing member, and the second movement control is performed on the basis of a result of a detection by the first temperature detection section or a result of a detection by the second temperature detection section.

21. The method according to claim 20, wherein the second movement control is performed on the basis of a detection result greater than an upper limit of the predetermined temperature range, the detection result being the result of the detection by the first temperature detection section or the result of the detection by the second temperature detection section.

22. The method according to claim 20, wherein the second movement control is performed on the basis of a detection result lower than a lower limit of the predetermined temperature range, the detection result being the result of the detection by the first temperature detection section or the result of the detection by the second temperature detection section.

23. The method according to claim 20, wherein the second movement control is performed on the basis of a detection result having a greater difference from the predetermined temperature range, the detection result being the result of the detection by the first temperature detection section or the result of the detection by the second temperature detection section.

* * * * *